US009167351B1

(12) United States Patent
Roper

(10) Patent No.: US 9,167,351 B1
(45) Date of Patent: Oct. 20, 2015

(54) HEATED QUARTZ CRYSTAL RESONATOR WITH STRAIN ISOLATION AND METHOD OF FABRICATING SAME

(71) Applicant: HRL LABORATORIES, LLC, Malibu, CA (US)

(72) Inventor: Christopher S. Roper, Pacific Palisades, CA (US)

(73) Assignee: HRL Laboratories, LLC, Malibu, CA (US)

( * ) Notice: Subject to any disclaimer, the term of this patent is extended or adjusted under 35 U.S.C. 154(b) by 246 days.

(21) Appl. No.: 13/968,218

(22) Filed: Aug. 15, 2013

Related U.S. Application Data

(62) Division of application No. 13/161,118, filed on Jun. 15, 2011, now Pat. No. 8,567,041.

(51) Int. Cl.
*H04R 17/00* (2006.01)
*H04R 17/10* (2006.01)

(52) U.S. Cl.
CPC ..... *H04R 17/10* (2013.01)

(58) Field of Classification Search
USPC ..... 310/343
See application file for complete search history.

(56) References Cited

U.S. PATENT DOCUMENTS

| | | | | |
|---|---|---|---|---|
| 3,431,392 A | | 3/1969 | Garland et al. | 219/210 |
| 3,715,563 A | * | 2/1973 | Bloch | 219/210 |
| 3,818,254 A | | 6/1974 | Persson | 310/8.1 |
| 4,091,303 A | | 5/1978 | Tadataka et al. | 310/343 |
| 4,748,367 A | * | 5/1988 | Bloch et al. | 310/343 |
| 4,985,687 A | | 1/1991 | Long | 331/69 |
| 5,289,075 A | * | 2/1994 | Besson et al. | 310/367 |
| 6,049,256 A | * | 4/2000 | Fry | 331/69 |
| 6,060,692 A | * | 5/2000 | Bartley et al. | 219/210 |
| 7,071,598 B2 | * | 7/2006 | Satoh | 310/343 |
| 7,237,315 B2 | | 7/2007 | Kubena | 29/594 |
| 7,555,824 B2 | | 7/2009 | Chang et al. | 29/594 |
| 7,559,130 B2 | | 7/2009 | Kubena | 29/594 |
| 7,619,289 B2 | * | 11/2009 | Kim et al. | 257/414 |
| 8,610,336 B1 | * | 12/2013 | Wang et al. | 310/343 |
| 2007/0205839 A1 | | 9/2007 | Kubena et al. | 331/158 |
| 2007/0216490 A1 | | 9/2007 | Kubena et al. | 331/158 |
| 2008/0258829 A1 | | 10/2008 | Kubena et al. | 331/158 |
| 2009/0189294 A1 | | 7/2009 | Chang et al. | 257/777 |

OTHER PUBLICATIONS

Tinta, Matistic, and Lagasse "The Direct Temperature Control of Quartz Crystals in Evacuated Enclosures" IEEE 24th Annual Symposium on Frequency Control, 1970.

OCXOs for Portable Equipment (Is a directly heated oscillator right for you?) by Greg Arthur Feb. 1, 2008, www2.electronicproducts.com/OCXOs_for_portable_equipment-article-facnvalpey-feb2008-html.aspx.

* cited by examiner

*Primary Examiner* — Jaydi San Martin
(74) *Attorney, Agent, or Firm* — Ladas & Parry

(57) ABSTRACT

A heated resonator includes a base substrate, a piezoelectric piece having a thickness and a top side and a bottom side, a first electrode on the top side, a second electrode opposite the first electrode on the bottom side, an anchor connected between the piezoelectric piece and the base substrate, and a heater on the piezoelectric material. A thermal resistor region in the piezoelectric piece is between the heater and the anchor.

12 Claims, 10 Drawing Sheets

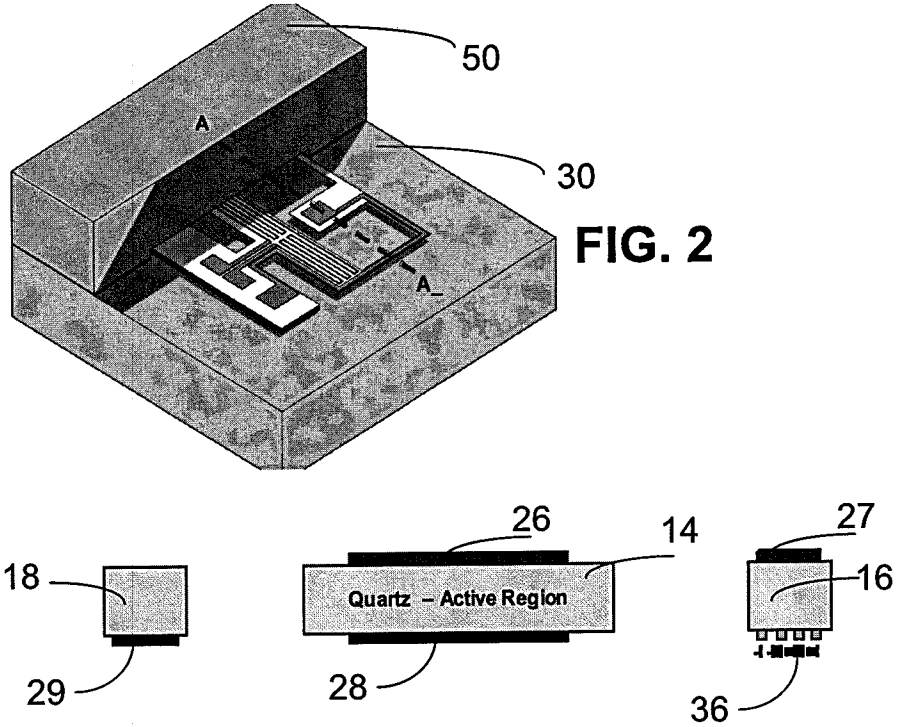
FIG. 2
FIG. 3
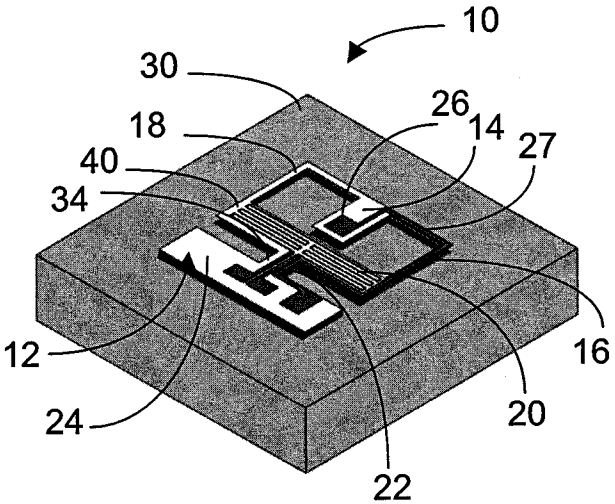
FIG. 1

For -20°C to +60°C External Temperature and Internal Control to 0.1°C, Simulation Predicts ± 8ppb Stability

| External Temperature (°C) |
|---|
| -20 |
| 20 |
| 60 |

| PARAMETER | T (microns) | W1 (microns) | W2 (microns) | L1/W1 | L2/W2 | W3 (microns) | L3/W3 | W4 (microns) | L4/W4 | N |
|---|---|---|---|---|---|---|---|---|---|---|
| MIN | 0.5 | 2 | 2 | 1 | 1 | 20 | 0.1 | 8 | 0.1 | 0 |
| MAX | 250 | 250 | 250 | 1000 | 1000 | 2000 | 10 | 1000 | 100 | 20 |
| BEST PRACTICE | 10 | 30 | 30 | 10 | 10 | 100 | 2 | 100 | 1 | 1 |

HEATED QUARTZ CRYSTAL RESONATOR WITH STRAIN ISOLATION AND METHOD OF FABRICATING SAME

CROSS REFERENCE TO RELATED APPLICATIONS

This is a divisional application of U.S. patent application Ser. No. 13/161,118, filed on Jun. 15, 2011, which is incorporated herein as though set forth in full.

STATEMENT REGARDING FEDERAL FUNDING

This invention was made under U.S. Government contract 2007-1095-726-000. The U.S. Government has certain rights in this invention.

FIELD

This disclosure relates to quartz crystal resonators and oscillators, and in particular to heated ovenized quartz crystal resonators and oscillators and methods for fabricating them.

BACKGROUND

In the prior art it is well known that ovenizing or heating a quartz crystal oscillator can stabilize the oscillator frequency. The prior art for directly heated ovenized quartz crystal oscillators includes the following: Tinta, Matistic, and Lagasse "The Direct Temperature Control of Quartz Crystals in Evacuated Enclosures" IEEE 24th Annual Symposium on Frequency Control, 1970; U.S. Pat. No. 3,715,563 to Bloch; U.S. Pat. No. 4,748,367 to Tanuma et al.; U.S. Pat. No. 4,091,303 to Takataka et al.; U.S. Pat. No. 4,985,687 to Long; U.S. Pat. No. 3,431,392 to Garland et al.; and U.S. Pat. No. 3,818,254 to Persson.

Example products on the market are manufactured and sold by Valpey Fisher, Statek, Micro Crystal Switzerland, Vectron and others.

These oscillators suffer from a number of deficiencies. First, strains generated due to the thermal mismatch of the quartz and the metal electrodes, especially near the heater, may be transmitted to an active region, which can shift the fundamental resonance frequency and negatively affect the oscillator stability.

Also temperature uniformity is heavily dependent on heater geometry. Slight spatial variations in the thickness of the heater metal and/or heater width can lead to spatial variations in the dissipated power density in the heater, which can result in spatial temperature non-uniformities that negatively affect oscillator stability.

In certain designs with better temperature uniformity, the heater electrode may directly oppose a signal electrode, which can excite undesired resonance in unintended regions of the quartz crystal and negatively affect frequency stability.

Existing ovenized oscillators consume >200 mW of power at −20° C., have warm-up times greater than 30 seconds, and have a frequency stability ranging from 100s to ⅒s of ppb, with smaller oscillators having poorer performance.

Other more traditional ovenized oscillator designs and products exist, but they consume even higher power than directly heated quartz oscillators. For example, see OCXOs for Portable Equipment (Is a directly heated oscillator right for you?) by Greg Arthur Feb. 1, 2008, www2.electronicproducts.com/OCXOs_for_portable_equipment-article-facnvalpey-feb2008-html.aspx.

The prior art for micromachined quartz crystal oscillators and resonators includes: U.S. Pat. No. 7,559,130 to Kubena et al.; U.S. Pat. No. 7,237,315 to Kubena et al.; U.S. Pat. No. 7,555,824 to Chang et al.; US Published Patent Application No. 20090189294 by Chang et al.; US Published Patent Application No. 20080258829 by Kubena et al.; US Published Patent Application No. 20070216490 by Kubena et al.; and US Published Patent Application No. 20070205839 by Kubena et al.

What is needed is a directly heated ovenized quartz crystal oscillator that is small, and which has a low power consumption, a fast warm-up period, and improved frequency stability. Also needed is a method of making such a quartz crystal oscillator. The embodiments of the present disclosure answer these and other needs.

SUMMARY

In a first embodiment disclosed herein, a heated resonator comprises a base substrate, a piezoelectric piece having a thickness and a top side and a bottom side, a first electrode on the top side, a second electrode opposite the first electrode on the bottom side, an anchor connected between the piezoelectric piece and the base substrate, a heater on the piezoelectric material, and a thermal resistor region in the piezoelectric piece between the heater and the anchor.

In another embodiment disclosed herein, a heated resonator comprises a base substrate, a piezoelectric piece having a thickness and a top side and a bottom side, a first electrode on the top side, a second electrode opposite the first electrode on the bottom side, an anchor connected between the piezoelectric piece and the base substrate, a heater adjacent the anchor; wherein the piezoelectric piece further comprises at least one first flexure between the first electrode and the anchor; and wherein the piezoelectric piece further comprises at least one second flexure between the second electrode and the anchor.

In yet another embodiment disclosed herein, a method for fabricating a heated quartz crystal resonator comprises depositing and patterning a top side electrode on a quartz wafer, depositing and patterning a top side heater on the quartz wafer, bonding the quartz wafer to a handle wafer, grinding and polishing the quartz wafer to a thickness for a desired frequency, depositing and patterning a mask for a quartz layer and vias, etching vias and devices in the quartz wafer, depositing and patterning via metal, depositing and patterning resistive temperature device metal on the quartz wafer, depositing and patterning a bottom side electrode metal on the quartz wafer, depositing and patterning a mesa on a base wafer, depositing and patterning metal on the base wafer for both a seal ring, wiring, and a reflective coating, depositing and patterning a mask for a cap cavity in a cap wafer, etching the cap cavity, depositing and patterning metal on the cap wafer, depositing and patterning metal seal layers on the cap wafer, bonding the quartz wafer to the base wafer, removing the handle wafer; and bonding the cap wafer to the base wafer.

These and other features and advantages will become further apparent from the detailed description and accompanying figures that follow. In the figures and description, numerals indicate the various features, like numerals referring to like features throughout both the drawings and the description.

BRIEF DESCRIPTION OF THE DRAWINGS

FIG. 1 shows a heated quartz crystal oscillator in accordance with the present disclosure;

FIG. 2 shows the heated quartz crystal oscillator of FIG. 1 with a cap in accordance with the present disclosure;

FIG. 3 shows an elevational cross section along line A-A' of FIG. 2 in accordance with the present disclosure;

DETAILED DESCRIPTION

Figures 4A, 4B, 4C:
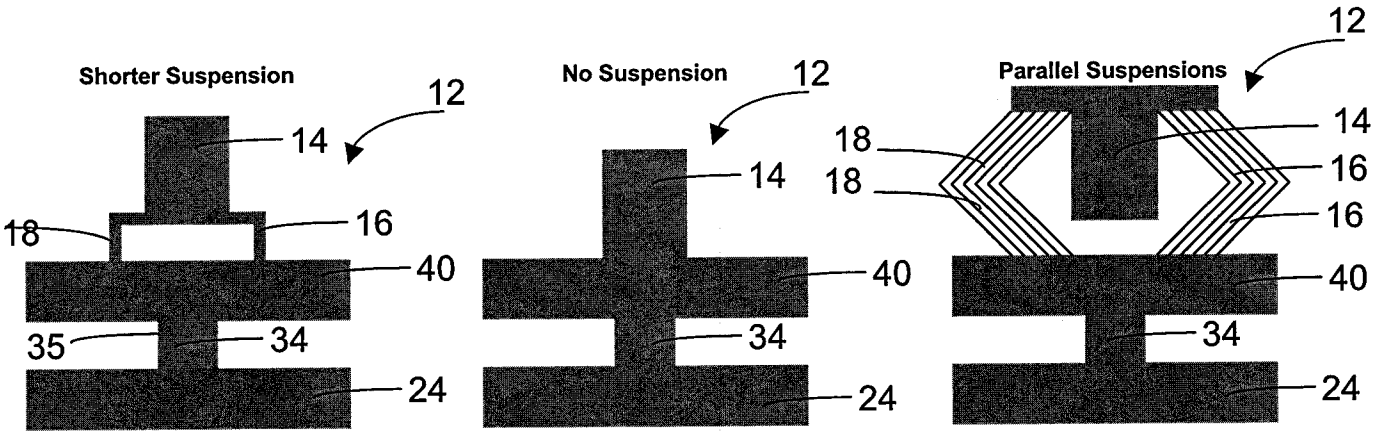
FIGS. 4A and 4C show strain relief suspensions in accordance with the present disclosure.
FIG. 4B shows an embodiment without a strain relief suspension but still having a thermal resistor region in accordance with the present disclosure.

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

Referring now to FIG. 1, a heated quartz crystal oscillator 10 is shown in accordance with the present disclosure. The heated quartz crystal oscillator 10 is a miniature ovenized quartz crystal oscillator. The reference numbers used in FIG. 1 are used for the same components in other figures, including FIGS. 4A, B, and C.

The crystal oscillator 10 includes a unitary piece of quartz 12 that may be micromachined to have a number of regions, in particular an active resonating region 14, a heater region 40, strain relief suspension regions 16 and 18 that join the active resonating region 14 to the heater region 40, and a via and bond pad region 24 that may be joined to heater region 40 by a thermal resistive region 34. The via and bond pad region 24 may also be referred to as a anchor region 24.

The quartz 12 in a preferred embodiment is SC-cut quartz, which may provide a low temperature coefficient of frequency and may minimize any thermal transient effect. Alternatively, the quartz 12 may be AT-cut quartz or any other cut of quartz. The thickness of quartz 12 may be between 100 nm and 200 micrometers. The active resonating region 14 has a top 26 and a bottom 28 electrode, which cause a piezoelectric resonance. Generally the thickness of quartz 12 along with electrode dimensions and electrode metal properties determine the resonant frequency of the piezoelectric resonance.

The strain relief suspension regions 16 and 18, which may be referred to as flexures, prevent strain in other portions of the device from affecting the resonance frequency. Strain in other portions of the device may include an anchor strain from anchor 62 shown in FIG. 6, coefficient of thermal expansion mismatch strain, and strain from temperature gradients in the heater region 40.

The strain relief suspension regions 16 and 18 may include one or more quartz beams connecting the active resonating region 14 to the other regions of the unitary piece of quartz 12. The strain relief suspension regions 16 and 18 are preferably compliant in two orthogonal directions with both directions being orthogonal to the direction of the thickness of the quartz 12. Each strain relief suspension region 16 and 18 may consist of segments. In one embodiment each segment may have an aspect ratio (AR), which is the ratio of length to thickness, greater than 1, as shown in FIG. 4A. In a preferred embodiment the aspect ratio is greater than 10. In another embodiment such as shown in FIG. 4C each strain relief suspension region 16 and 18 has many high aspect ratio segments connected in parallel. The segments may also consist of segments of varying angles as shown in FIGS. 1, 4A and 4C.

The strain relief suspension regions 16 and 18 preferably have a high compliance, but low thermal resistance to meet the objectives of low mechanical strain transmission to the resonating region 14 and fast warm-up time. Since mechanical compliance scales as the cube of aspect ratio (AR^3), while thermal resistance scales as ARA^1, designs which place multiple high aspect ratio beams in parallel have equivalent thermal conductivity and warm up time, but higher compliance and lower strain transmission, and thus higher frequency stability compared to a single beam with the same length and width equal to the sum of the widths in the parallel case.

FIG. 4B shows an embodiment without a strain relief suspensions 16 and 18 between resonance region 14 and the rest of the quartz 12; however the embodiment still has a thermal resistor region 34, which has a narrowed area or constriction 35 in the micromachined quartz 12, which still provides some improved performance including improved frequency stability. The narrowed area or constriction 35 in the micromachined quartz 12, which is shown in FIGS. 4A, 4B and 4C, provides some strain relief for the resonance region 14 from the a via and bond pad region 24 and from anchor strain from anchor 62, shown in FIG. 6. Thus, the embodiment of FIG. 4B exhibits improved performance over a design without a constriction 35 for the thermal resistor region 34.

FIG. 2 shows the heated quartz crystal oscillator 10 of FIG. 1 with a portion of a cap 50 in accordance with the present disclosure. FIG. 3 shows an elevational cross section along line A-A' of FIG. 2. As best shown in FIG. 3, a metal electrode 26 is patterned on the top side of the active resonating region 14 and another metal electrode 28 is patterned on the bottom side of the active resonating region 14. Preferably both electrodes are the same size, and their shape is preferably rectangular. The electrodes 26 and 28 may be preferably gold (Au) or aluminum and preferably between 80 nm and 900 nm thick. In one embodiment an adhesion layer 0.1-10 nm thick may be between the metal and the quartz resonating region 14. Possible adhesion layers include Ti or Cr for Au and alumina for aluminum.

The electrodes are connected to two metal leads. The top electrode 26 on the active resonating region 14 is connected to a lead 27 that runs along the top of strain relief suspension region 16, as shown in FIGS. 1 and 3. The bottom electrode 28 on the active resonating region 14 is connected to a lead 29 that runs along the bottom of strain relief suspension region 18, as best shown in FIG. 3. Preferably the lead 27 and the lead 29 are made of the same metal as the electrodes and are preferably the same thickness as the electrodes.

A heater 20 is patterned on the heater region 40 of quartz 12. Preferably the heater 20 is a resistive metal heater, and may be Au or platinum (Pt). Also preferably the heater 20 is patterned in a serpentine fashion for an increased aspect ratio of length to thickness. Preferably the heater 20 is on the top side of the heater region 40 of quartz 12; however the heater 20 may be optionally on the bottom side of the of the heater region 40 of quartz 12. If the heater 20 is on top side of heater region 40 of quartz 12, two heater leads are preferably connected from each end of the heater 20 to through-quartz vias. Optionally each lead of the heater 20 may be connected to a bond pad if the heater 20 is on the bottom side of heater region 40 of quartz 12.

As discussed above, the thermal resistor region 34 may have a constriction 35, as shown in FIG. 4A, in the micromachined quartz 12. The purpose of the thermal resistor region 34 is to prevent the heat from heater 20 in heater region 40 from escaping via the via and bond region 24, thus reducing the power required for the heater 20. The thermal resistance of the thermal resistor region 34 is determined by the length of thermal resistor region 34, the cross sectional area of quartz in the thermal resistor region 34, the thermal conductivity of any metal traces passing through the thermal resistor region 34, the thermal conductivity of quartz 12, and the cross section area of any metal traces passing through the thermal resistor region 34.

One or more vias through the quartz 12 allow electrical contact between the bond pads and metal features on the top side of the quartz 12. Each via typically is a hole in the quartz which is filled either partially or completely with a metal and preferably gold. Four or more bond pads provide electrical connection between components on the quartz 12 to the mesa 60, shown in FIG. 6.

Figure 6:
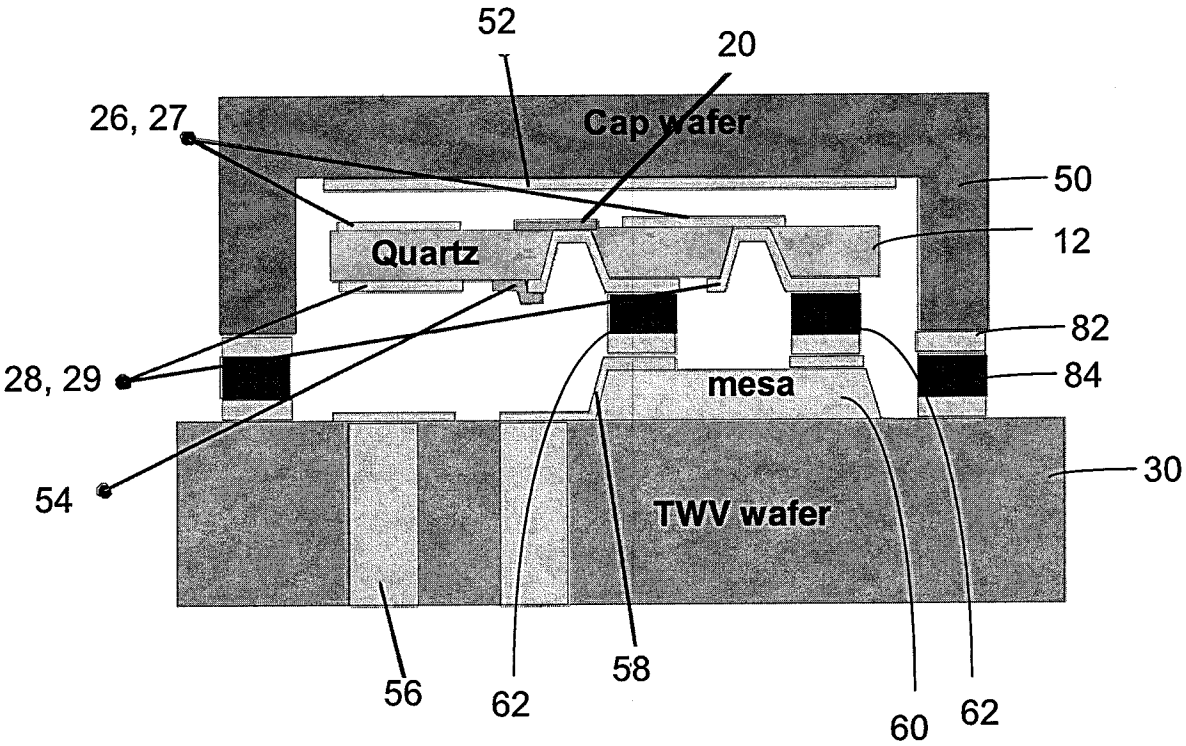
FIG. 6 shows a cross section of a heated quartz crystal oscillator in accordance with the present disclosure.

At least one temperature measuring instrument is preferably patterned on the quartz 12 and positioned close to the electrodes 26 and 28, but not so close as the interfere with the quartz resonance. The temperature measuring instrument may be a resistance temperature detector 54, as shown in FIG. 6 and is preferably platinum. Optionally the temperature measuring instrument may be a thermocouple positioned outside the cavity of the cap wafer 50, shown in FIG. 6, or the temperature measuring instrument may be a thermocouple positioned inside the cavity, for example on the cap wafer 50 or on the base wafer 30, but not on the micromachined quartz 12.

The base wafer 30, shown in FIG. 6, may preferably be an application specific integrated circuit (ASIC) or other electronics control substrate, including electronics to excite and maintain oscillation. The base wafer 30 may also include electronics to control the temperature of the resonance region of the quartz 12 to a selected temperature. The temperature control electronic may be preferably based on feedback control from a temperature measuring instrument inside the cavity of the cap wafer 50, or may optionally based on feedforward control from a temperature measuring instrument outside the cavity of the cap wafer 50, or may be optionally based on a combination of feedforward and feedback control.

The base wafer 30 optionally may be a homogeneous material such as silicon, silica, pyrex, etc., and optionally have through wafer vias (TWVs). The thickness of the base wafer 30 may range from 10 microns to 5 mm and is preferably around 300 microns.

Mesa 60 is a raised region on the base 30, as shown in FIG. 6. To form the mesa 60 either the base 30 is etched, the mesa 30 is deposited on the base 30, or the base 30 is etched combined with depositing additional material.

The wafer cap 50, as shown in FIG. 6, is preferably a homogeneous material such as silicon, silica, pyrex, etc., has a recess machined into it to form a cavity, has a thickness ranging from 10 microns to 5 mm and is preferably around 300 microns, and optionally has through wafer vias.

A bond seal ring 82 forms a metal seal ring on the cap wafer and a complementary metal seal ring 84 on the base wafer provide a hermetic seal for the contents inside the cavity.

Metal traces may connect bond pads to either electrical connections of the ASIC or other electronics control on the base wafer 30, substrate, through-wafer vias, and under seal ring vias.

Figure 8:
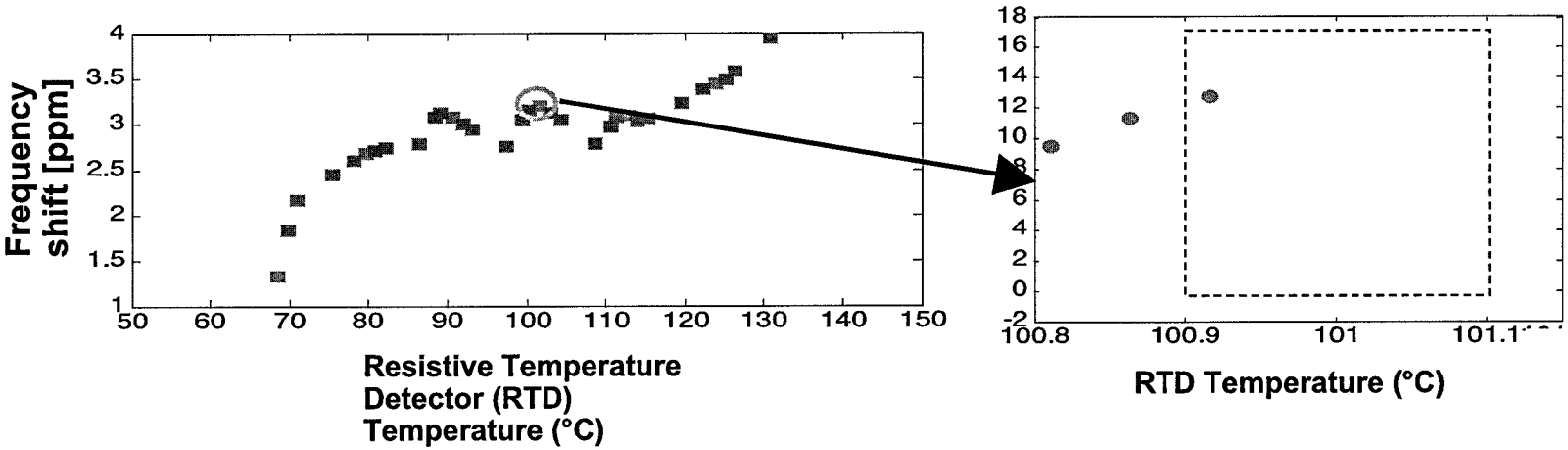
FIG. 8 shows frequency-temperature curves at varying heater powers and varying external temperatures for a directly heated ovenized quartz crystal oscillator with strain relief suspension in accordance with the present disclosure.

Other features which may improve the performance of the quartz crystal oscillator 10 include the following. Metal layers for radiation reflection 52, as shown in FIG. 8, may be patterned on the ceiling inside of the cap wafer 50, or on the base wafer 30. At least one getter may be placed inside the cavity to trap residual gases and/or contaminants after the cavity is sealed under vacuum.

There are a number of design features which represent variation on the best practice. The DC electrode may be electrically connected to one of the heater leads, requiring one fewer bond pad and possibly one fewer through-quartz via. Through wafer vias, such as via 56 may be utilized in the base wafer 30 to allow electrical connections to the interior of the cavity. Vias may be patterned to pass under the seal ring 84 and be electrically isolated from the seal ring to allow electrical connections to the interior of the cavity. Instead of through-quartz vias, wirebonding or an external fixture to make electrical contact to both sides of the quartz may be used. The feedback and/or feedforward control may be based on a temperature measurement inside the cavity, but not on the quartz 12, for example a temperature measurement device on the base wafer 30. The micromachined quartz 12 rather than being quartz, may be any piezoelectric material, such as aluminum nitride, lithium niobate, etc. Multiple electrodes may be placed on the top and bottom of the quartz 12 in the active resonating region 14 to create an ovenized monolithic crystal filter. The active resonating region 14 may be used as a resonator, meaning a resonator without an electronic circuit required for oscillator operation.

The purpose of the crystal oscillator 10 is to oscillate at a fixed frequency, independent of the temperature of its surroundings. It performs with similar or better frequency stability, in a smaller volume, while consuming lower power, and with a shorter warm-up time than existing ovenized oscillators. The total package size may be less than $1.2=^3$, compared to the smallest prior art ovenized oscillator, the Valpey Fisher VFOV400, which has a total volume of around 1250 $mm^3$. Existing ovenized oscillators consume >200 mW of power at −20° C., while the embodiments described herein may consume less than 4 mW of power at a temperature of −20° C. Prior art ovenized oscillators have warm-up times greater than 30 seconds, while the embodiment described herein may have a warm up time less than 10 seconds and in some cases less than 1 second. Prior art ovenized oscillators have a frequency stability ranging from 100s to 1/10s of ppb, with smaller oscillators having poorer performance. By comparison the embodiments described herein can match these frequency stability values of the larger oscillators in a size smaller than the smallest existing ovenized oscillator, and in addition, have frequency stability in the presence of acceleration or vibration superior to that of prior art ovenized oscillators.

The low power consumption means that when incorporated into a system, the battery which provides power to the heated quartz crystal oscillator 10 may be smaller. The fast warm-up time means that the oscillator can be turned on only when needed, resulting in a low average power consumption for a system incorporating the crystal oscillator 10 further reducing the battery size. Optionally, the reduction in power may provide an extended operational lifetime for a fixed battery size.

Figure 5:
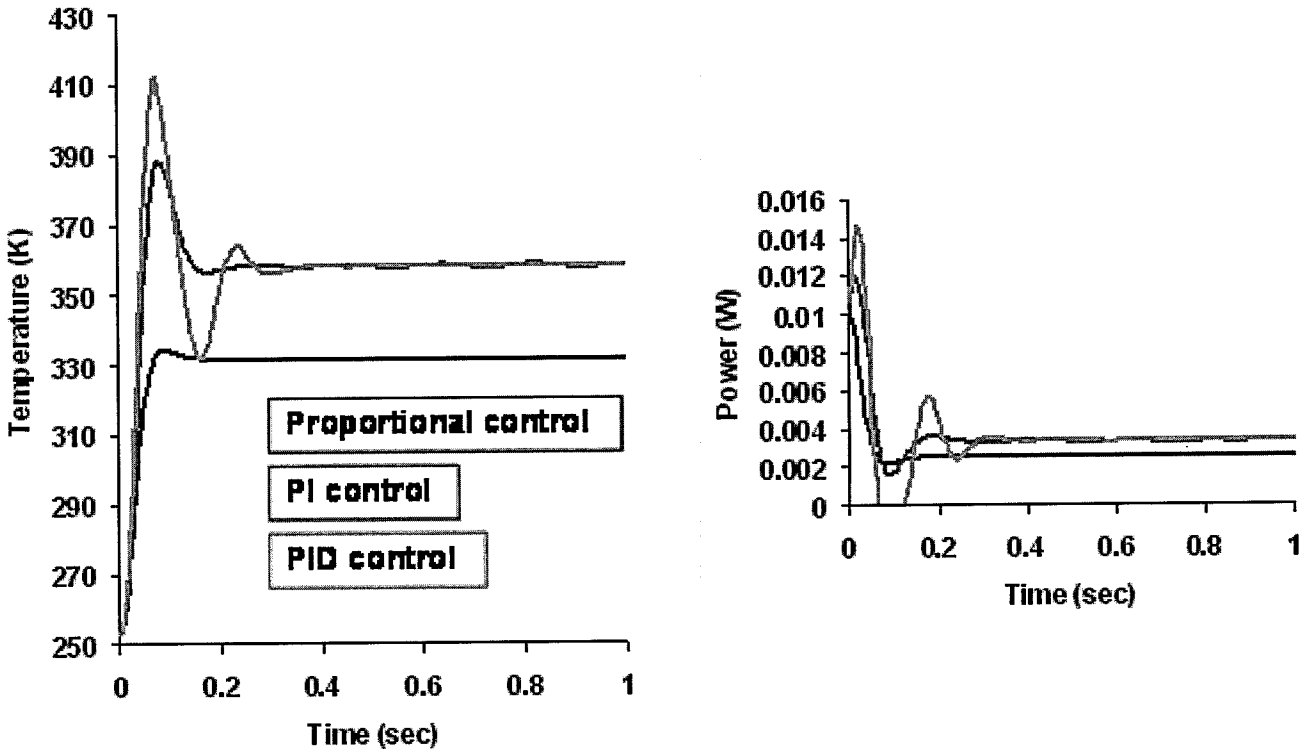
FIG. 5 shows a warm up time and power consumption of a heated quartz crystal oscillator in accordance with the present disclosure.

FIG. 5 shows a simulated transient response of one embodiment of the crystal oscillator 10 showing warm-up time <1 sec and steady state power consumption of <4 mW. FIG. 8 shows frequency-temperature curves at varying heater powers and varying external temperatures for a directly heated ovenized quartz crystal oscillator 10 with strain relief suspensions 16 and 18 for a −20 degrees C. to 60 degrees C. external temperature, and predicts that a resonance stability of plus or minus 8 ppb with internal temperature control to 0.1 degrees C.

Figures 7A, 7Q:
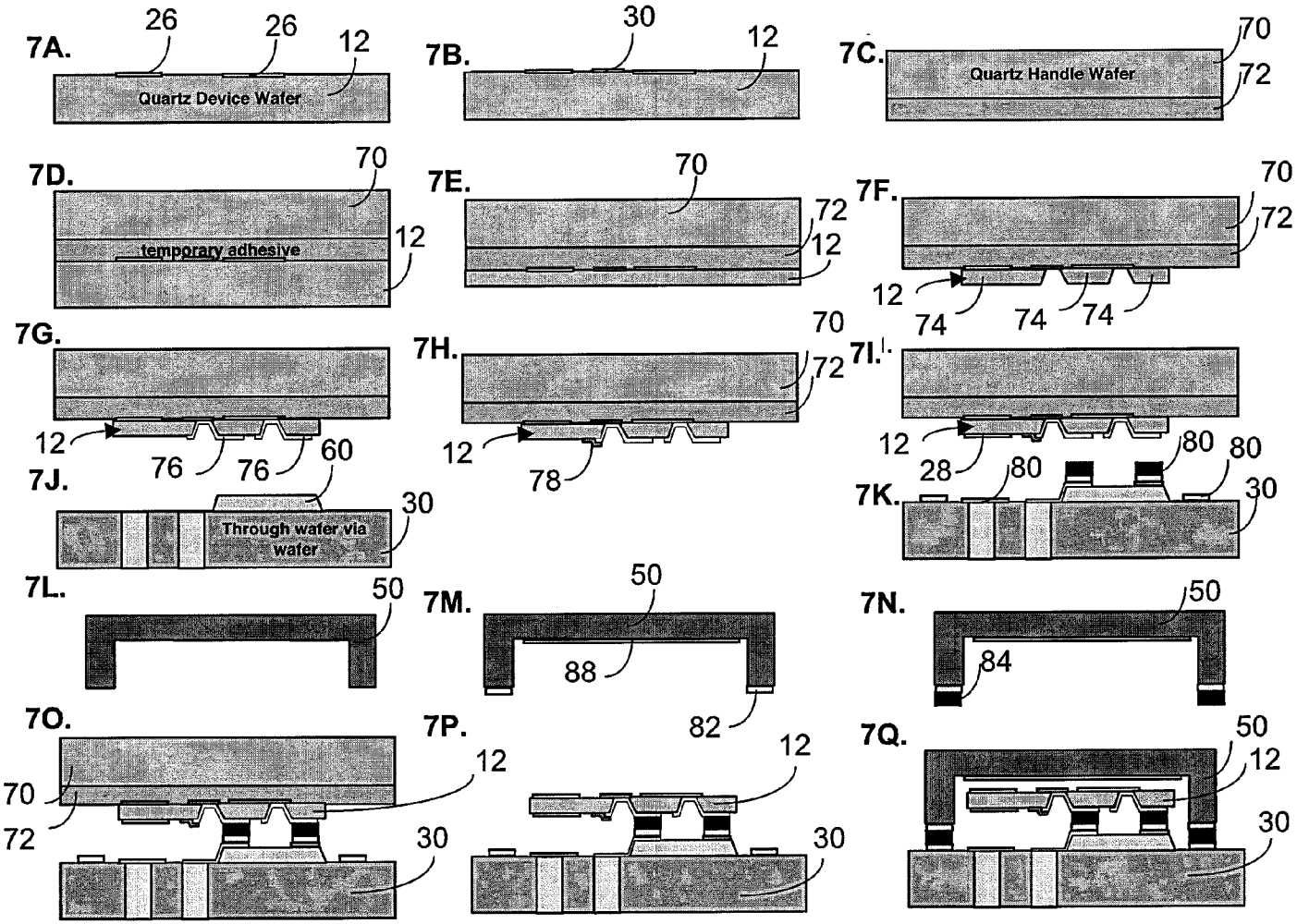
FIGS. 7A-7Q show a method process flow for fabrication of a heated quartz crystal oscillator in accordance with the present disclosure.
Figure 9A:
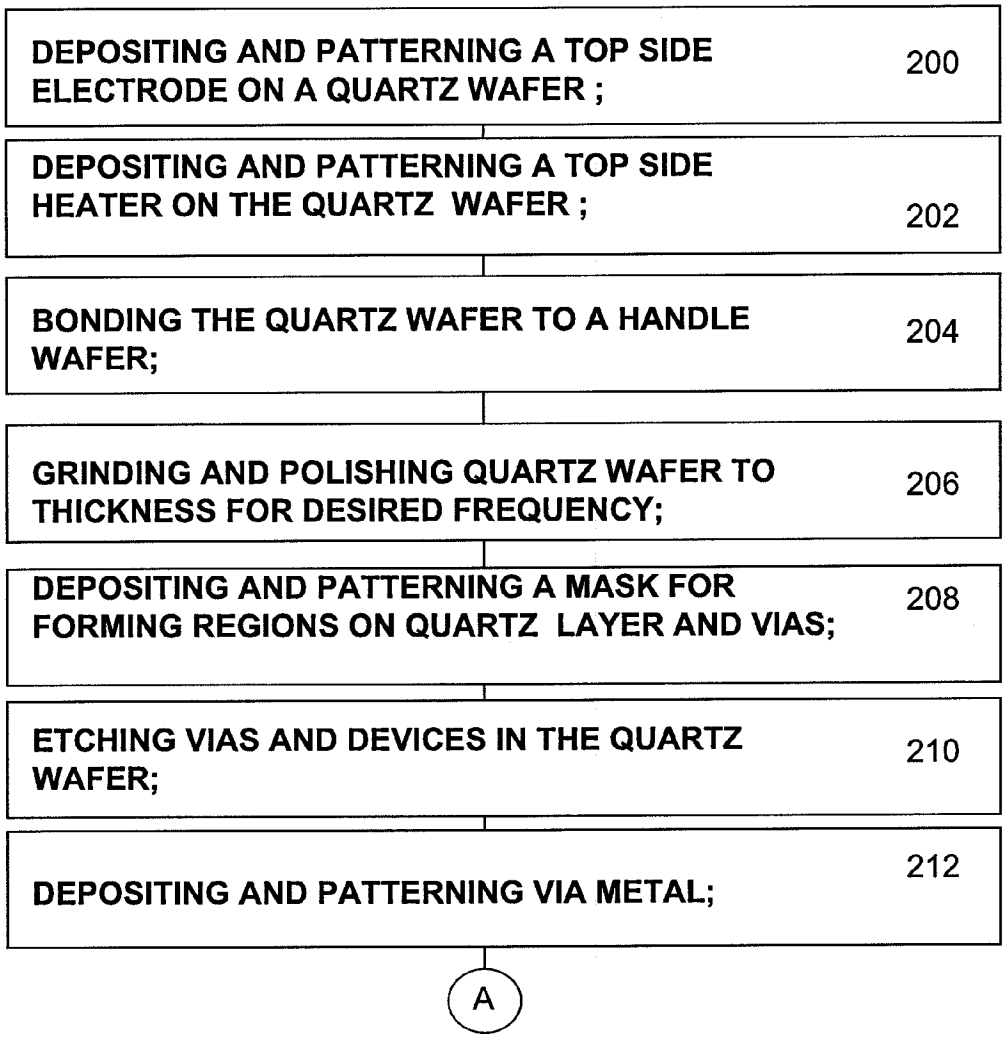
FIGS. 9A-9C are flow charts of a method for fabricating a heated ovenized quartz crystal oscillator with strain relief suspension in accordance with the present disclosure.
Figure 9B:
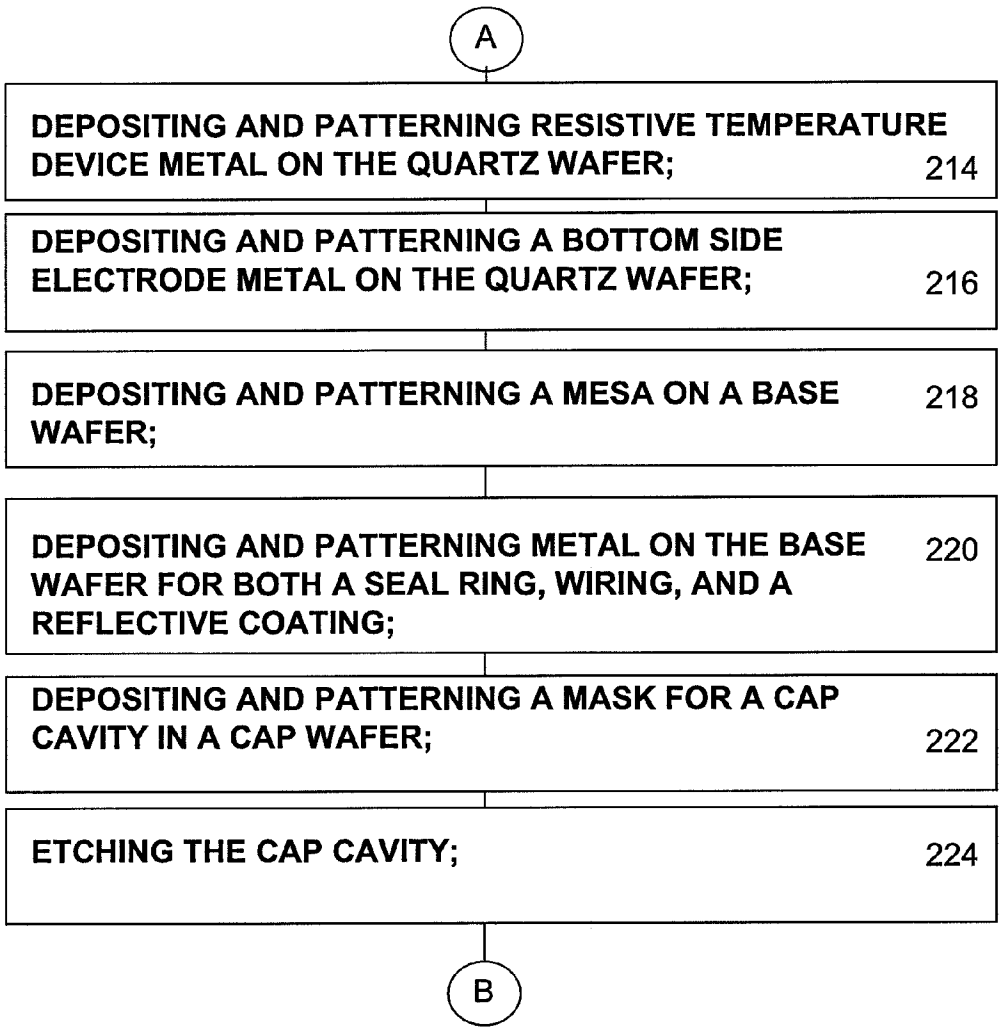
Figure 9C:
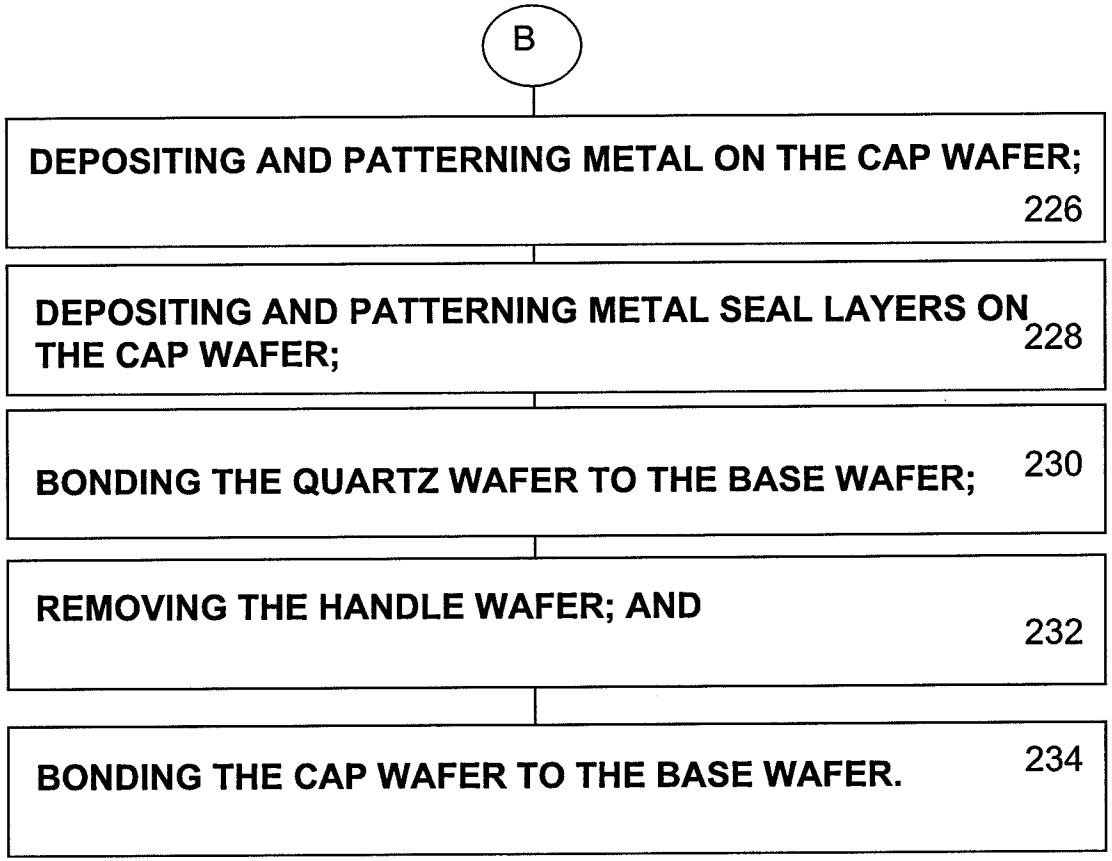

FIGS. 7A-7Q show a method process flow for fabrication of heated quartz crystal oscillator 10, and FIGS. 9A-9C are flow charts of a corresponding method for fabricating a heated ovenized quartz crystal oscillator 10 with strain relief suspension 16, 18 in accordance with the present disclosure.

The method includes step 200, as shown in FIGS. 9A and 7A, depositing and patterning a top side electrode 26 on a quartz wafer 12. Then in step 202, shown in FIG. 7B, depositing and patterning a top side heater 30 on the quartz wafer 12. Next, in step 204, bonding the quartz wafer 12 to a handle wafer 70, as shown in FIG. 7D. Optionally adhesive layer 72 may be applied to the handle wafer 70 first, as shown in FIG. 7C. Then in step 206 as shown in FIG. 7E, grinding and polishing the quartz wafer 12 to the thickness for the desired resonant frequency. Next in step 208, depositing and patterning a mask to form regions 74 in quartz 12, and vias. Then in step 210 etching vias and devices in the quartz wafer 12, as shown in FIG. 7F. Then in step 212 depositing and patterning metal 76 including via metal, as shown in FIG. 7G. Next, in step 214, depositing and patterning resistive temperature device metal 78 on the quartz 12, as shown in FIGS. 9B and 7H. Then in step 216, depositing and patterning a bottom side electrode metal 28 on the quartz 12, as shown in FIG. 71. Next in step 218, depositing and patterning a mesa 60 on a base wafer 30, as shown in FIG. 7J. Then in step 220, depositing and patterning metal 80 on the base wafer for a seal ring, wiring, and optionally a reflective coating, as shown in FIG. 7K. Next in step 222, depositing and patterning a mask for a cap cavity in a cap wafer 50, and in step 224, etching the cap cavity as shown in FIG. 7L. Then in steps 226 and 228, depositing and patterning metal 88 for radiation reflection on the cap wafer 50, and depositing and patterning metal seal layers 82 and 84 on the cap wafer, as shown in FIGS. 9C, 7M and 7N. Next in step 230 bonding the quartz 12 to the base wafer 30, as shown in FIG. 70. Then in step 232 removing the handle wafer 70, as shown in FIG. 7P. Finally, in step 234 bonding the cap wafer 50 to the base wafer 30.

Figures 10A, 10B:
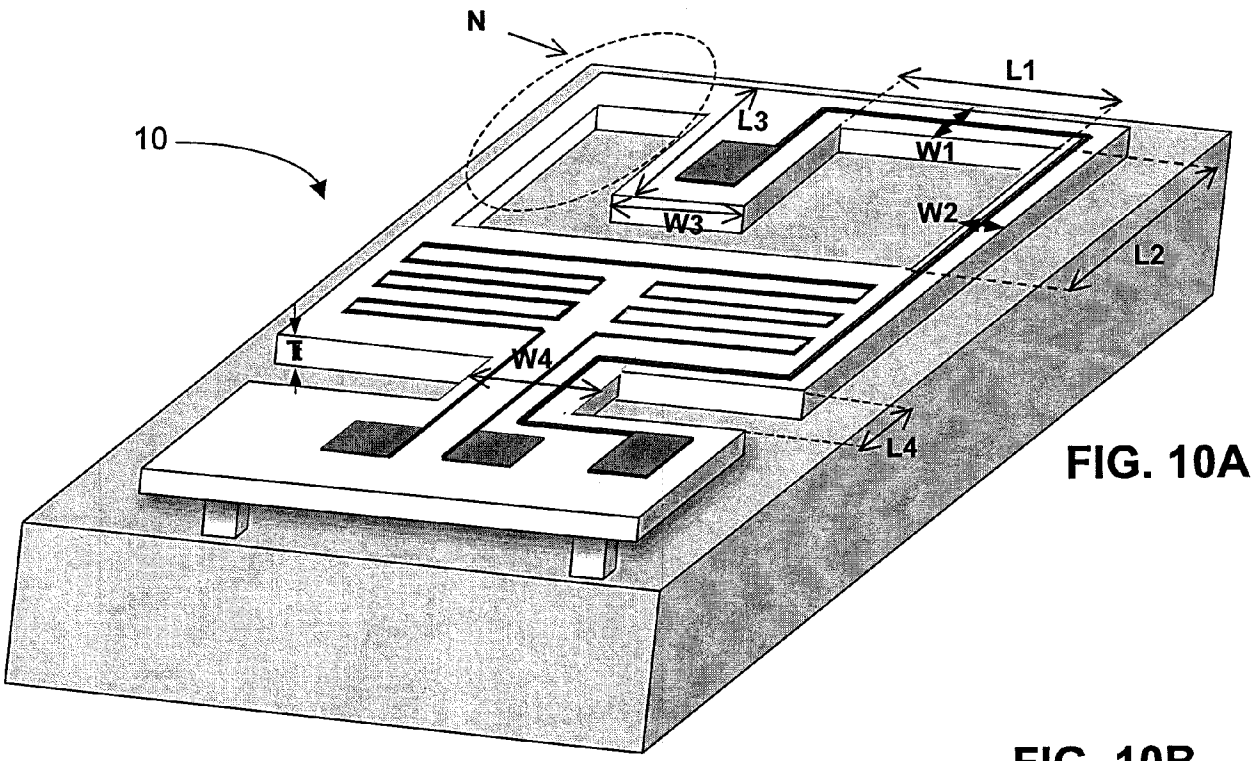
FIGS. 10A and 10B show dimensions of the heated quartz crystal oscillator in accordance with the present disclosure.

FIGS. 10A and 10B show dimensions of the heated quartz crystal oscillator in accordance with the present disclosure. N is the number of strain relief suspensions. The relationships of the other dimensions are evident in the FIGS. 10A and 10B. Minimum, maximum and best practice dimensions are shown.

Having now described the invention in accordance with the requirements of the patent statutes, those skilled in this art will understand how to make changes and modifications to the present invention to meet their specific requirements or conditions. Such changes and modifications may be made without departing from the scope and spirit of the invention as disclosed herein.

The foregoing Detailed Description of exemplary and preferred embodiments is presented for purposes of illustration and disclosure in accordance with the requirements of the law. It is not intended to be exhaustive nor to limit the invention to the precise form(s) described, but only to enable others skilled in the art to understand how the invention may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom. Applicant has made this disclosure with respect to the current state of the art, but also contemplates advancements and that adaptations in the future may take into consideration of those advancements, namely in accordance with the then current state of the art. It is intended that the scope of the invention be defined by the Claims as written and equivalents as applicable. Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the Claims. No claim element herein is to be construed under the provisions of 35 U.S.C. Sec. 112, sixth paragraph, unless the element is expressly recited using the phrase "means for . . . " and no method or process step herein is to be construed under those provisions unless the step, or steps, are expressly recited using the phrase "comprising the step(s) of . . . . "

What is claimed is:

1. A heated resonator comprising:
- a base substrate;
- a piezoelectric piece having a thickness and a top side and a bottom side;
- a first electrode on the top side;
- a second electrode opposite the first electrode on the bottom side;
- an anchor connected between the piezoelectric piece and the base substrate;
- a heater on the piezoelectric material; and
- a thermal resistor region in the piezoelectric piece between the heater and the anchor.

2. The heated resonator of claim 1 wherein the thermal resistor region is formed by a constriction in the piezoelectric piece.

3. The heated resonator of claim 1:
- wherein the heater is located on a heater region of the piezoelectric piece; and
- wherein the piezoelectric piece further comprises at least one first flexure between the heater region and the first electrode and at least one second flexure between the heater region and the second electrode.

4. The heated resonator of claim 1 wherein the piezoelectric material comprises quartz, SC-cut quartz, AT-cut quartz, aluminum nitride, or lithium niobate.

5. The heated resonator of claim 1 wherein the piezoelectric piece provides an electrical signal filter.

6. The heated resonator of claim 1 wherein the piezoelectric piece comprises:
- a resonating region comprising the first electrode and the second electrode;
- a heater region comprising the heater;
- a first strain relief region between the heater region and the first electrode and a second strain relief region between the heater region and the second electrode;
- an anchor region coupled to the anchor; and
- wherein the thermal resistor region is between the heater region and the anchor region.

7. The heated resonator of claim 6 wherein the thermal resistor region comprises a constriction in the piezoelectric piece.

8. The heated resonator of claim 1 wherein the piezoelectric piece thickness is less than 0.2 mm.

9. A heated resonator comprising:

a base substrate;

a piezoelectric piece having a thickness and a top side and a bottom side;

a first electrode on the top side;

a second electrode opposite the first electrode on the bottom side;

an anchor connected between the piezoelectric piece and the base substrate; and a heater adjacent the anchor on the base substrate;

wherein the piezoelectric piece further comprises at least one first flexure between the first electrode and the anchor; and wherein the piezoelectric piece further comprises at least one second flexure between the second electrode and the anchor.

10. The heated resonator of claim 9 wherein the piezoelectric material comprises quartz, aluminum nitride, or lithium niobate.

11. The heated resonator of claim 9 wherein the piezoelectric material comprises SC-cut quartz or AT-cut quartz.

12. The heated resonator of claim 9 wherein the piezoelectric piece thickness is less than 0.2 mm.

* * * * *